US010227683B2

(12) United States Patent
Hebesberger et al.

(10) Patent No.: US 10,227,683 B2
(45) Date of Patent: Mar. 12, 2019

(54) HIGH STRENGTH COLD ROLLED STEEL SHEET

(71) Applicant: VOESTALPINE STAHL GMBH, Linz (AT)

(72) Inventors: Thomas Hebesberger, Pasching (AT); Daniel Krizan, Linz (AT); Stefan Paul, Trieben (AT); Andreas Pichler, Vocklabruck (AT)

(73) Assignee: VOESTALPINE STAHL GMBH, Linz (AT)

( * ) Notice: Subject to any disclaimer, the term of this patent is extended or adjusted under 35 U.S.C. 154(b) by 675 days.

(21) Appl. No.: 14/380,956

(22) PCT Filed: Apr. 2, 2013

(86) PCT No.: PCT/EP2013/056940
§ 371 (c)(1),
(2) Date: Aug. 26, 2014

(87) PCT Pub. No.: WO2013/144373
PCT Pub. Date: Oct. 3, 2013

(65) Prior Publication Data

US 2015/0059935 A1 Mar. 5, 2015

(30) Foreign Application Priority Data

Mar. 30, 2012 (WO) ..... PCT/EP2012/055913

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/06*** | (2006.01) |
| ***C22C 38/20*** | (2006.01) |
| ***C22C 38/28*** | (2006.01) |
| ***C22C 38/32*** | (2006.01) |
| ***C22C 38/38*** | (2006.01) |
| ***C22C 38/42*** | (2006.01) |
| ***C22C 38/50*** | (2006.01) |
| ***C22C 38/54*** | (2006.01) |
| ***C21D 1/26*** | (2006.01) |
| ***C21D 8/02*** | (2006.01) |
| ***C22C 38/44*** | (2006.01) |
| ***C22C 38/46*** | (2006.01) |
| ***C22C 38/48*** | (2006.01) |

(52) U.S. Cl.
CPC ..... *C22C 38/58* (2013.01); *C21D 1/26* (2013.01); *C21D 8/0247* (2013.01); *C22C 38/001* (2013.01); *C22C 38/002* (2013.01); *C22C 38/02* (2013.01); *C22C 38/06* (2013.01); *C22C 38/20* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C22C 38/58; C22C 38/54; C22C 38/50
USPC ..... 148/623
See application file for complete search history.

(56) References Cited

U.S. PATENT DOCUMENTS

| | | | | |
|---|---|---|---|---|
| 5,470,529 | A | 11/1995 | Nomura et al. | |
| 2005/0133124 | A1* | 6/2005 | Kawano et al. | 148/546 |
| 2008/0251160 | A1* | 10/2008 | Akamizu et al. | 148/332 |

FOREIGN PATENT DOCUMENTS

| | | | |
|---|---|---|---|
| CN | 101928875 | A | 12/2010 |
| EP | 1870482 | A1 | 12/2007 |
| GB | 2438618 | A | 12/2007 |
| JP | 2004332099 | A | 11/2004 |
| JP | 2005-281787 | | 10/2005 |
| JP | 2006002186 | A | 1/2006 |
| JP | 2006283131 | A | 10/2006 |
| JP | 2007-262553 | | 10/2007 |
| JP | 2008-214752 | | 9/2008 |
| JP | 2008280577 | A | 11/2008 |
| JP | 2008-308717 | | 12/2008 |
| JP | 2010-138458 | | 6/2010 |
| JP | 2010-236066 | | 10/2010 |
| JP | 2011-195956 | | 10/2011 |
| JP | 2011202269 | A | 10/2011 |
| JP | 2012-012656 | | 1/2012 |
| JP | 2012052199 | A | 3/2012 |
| KR | 20100076409 | A | 7/2010 |

OTHER PUBLICATIONS

Machine translation of JP 2004332099, 2004.*
Chinese Office Action; Patent Application No. 201380015603.2 dated Jun. 3, 2015; 8 pages.
China Application Serial No. 201380015603.2; Second Office Action; dated Mar. 28, 2016; 9 pages.
Chinese Office Action; Patent Application No. 201380015603.2 dated Aug. 25, 2016; 3 pages.
International Patent Application No. PCT/EP2013/056940; International Search Report and Written Opinion; dated Jul. 17, 2013; 9 pages.
Japanese Office Action dated Nov. 8, 2016, for Japanese Patent Application No. 2015-502385.
Japanese Office Action dated Feb. 7, 2017, for Japanese Patent Application No. 2015-502381.
European Office Action dated Jul. 28, 2017, for European Patent Application No. 13713452.4.

* cited by examiner

*Primary Examiner* — Edward Johnson
(74) *Attorney, Agent, or Firm* — Karceski IP Law, PLLC

(57) ABSTRACT

The present invention relates to high strength cold rolled steel sheet suitable for applications in automobiles, construction materials and the like, specifically high strength steel excellent in formability. In particular, the invention relates to cold rolled steel sheets having a tensile strength of at least 780 MPa.

29 Claims, No Drawings

HIGH STRENGTH COLD ROLLED STEEL SHEET

CROSS-REFERENCE TO RELATED APPLICATION(S)

This is a National Stage Entry into the United States Patent and Trademark Office from International PCT Patent Application No. PCT/EP2013/056940, having an international filing date of Apr. 2, 2013 and to Priority Patent Application No. PCT/EP2012/055913 having the priority date of Mar. 30, 2012, the contents of both of which are incorporated by reference.

TECHNICAL FIELD

The present invention relates to high strength cold rolled steel sheet suitable for applications in automobiles, construction materials and the like, specifically a high strength steel sheet excellent in formability. In particular, the invention relates to a cold rolled steel sheet having a tensile strength of at least 780 MPa.

BACKGROUND ART

For a great variety of applications increased strength levels are pre-requisite for light weight constructions in particular in the automotive industry, since car body mass reduction results in reduced fuel consumption.

Automotive body parts are often stamped out of sheet steels, forming complex structural members of thin sheet. However, such part cannot be produced from conventional high strength steels because of a too low formability for complex structural parts. For this reason multiphase Transformation Induced Plasticity aided steels (TRIP steels) have gained considerable interest in the last years.

TRIP steels possess a multi-phase microstructure, which includes a meta-stable retained austenite phase, which is capable of producing the TRIP effect. When the steel is deformed, the austenite transforms into martensite, which results in remarkable work hardening. This hardening effect, acts to resist necking in the material and postpone failure in sheet forming operations. The microstructure of a TRIP steel can greatly alter its mechanical properties. The most important aspects of the TRIP steel microstructure are the volume percentage, size and morphology of the retained austenite phase, as these properties directly affect the austenite to martensite transformation when the steel is deformed. There are several ways in which to chemically stabilize austenite at room temperature. In low alloy TRIP steels the austenite is stabilized through its carbon content and the small size of the austenite grains. The carbon content necessary to stabilize austenite is approximately 1 wt. %. However, high carbon content in steel cannot be used in many applications because of impaired weldability.

Specific processing routs are therefore required to concentrate the carbon into the austenite in order to stabilize it at room temperature. A common TRIP steel chemistry also contains small additions of other elements to help in stabilizing the austenite as well as to aid in the creation of microstructures which partition carbon into the austenite. The most common additions are 1.5 wt. % of both Si and Mn. In order to inhibit the austenite to decompose during the bainite transformation it is generally considered necessary that the silicon content should be at least 1 wt. %. The silicon content of the steel is important as silicon is insoluble in cementite. US 2009/0238713 discloses such a TRIP steel. However, a high silicon content can be responsible for a poor surface quality of hot rolled steel and a poor coatability of cold rolled steel. Accordingly, partial or complete replacement of silicon by other elements has been investigated and promising results have been reported for Al-based alloy design. However, a disadvantage with the use of aluminium is the segregation behaviour during casting, which results in a depletion of Al in the centre position of the slabs resulting in an increased risk of the formation of martensite bands in the final microstructure.

Depending on the matrix phase the following main types of TRIP steels are cited:

TPF TRIP steel with matrix of polygonal ferrite

TPF steels, as already mentioned before-hand, contain the matrix from relatively soft polygonal ferrite with inclusions from bainite and retained austenite. Retained austenite transforms to martensite upon deformation, resulting in a desirable TRIP effect, which allows the steel to achieve an excellent combination of strength and drawability. Their stretch flangability is however lower compared to TBF, TMF and TAM steels with more homogeneous microstructure and stronger matrix.

TBF TRIP steel with matrix of bainitic ferrite

TBF steels have been known for long and attracted a lot of interest because the bainitic ferrite matrix allows an excellent stretch flangability. Moreover, similarly to TPF steels, the TRIP effect, ensured by the strain-induced transformation of metastable retained austenite islands into martensite, remarkably improves their drawability.

TMF TRIP steel with matrix of martensitic ferrite

TMF steels also contain small islands of metastable retained austenite embedded into strong martensitic matrix, which enables these steels to achieve even better stretch flangability compared to TBF steels. Although these steels also exhibit the TRIP effect, their drawability is lower compared to TBF steels.

TAM TRIP steel with matrix of annealed martensite

TAM steels contain the matrix from needle-like ferrite obtained by re-annealing of fresh martensite. A pronounced TRIP effect is again enabled by the transformation of metastable retained austenite inclusions into martensite upon straining. Despite their promising combination of strength, drawability and stretch flangability, these steels have not gained a remarkable industrial interest due to their complicated and expensive double-heat cycle.

DISCLOSURE OF THE INVENTION

The present invention is directed to a high strength cold rolled steel sheet having a tensile strength of at least 780 MPa and having an excellent formability and a method of producing the same on an industrial scale. In particular, the invention relates to a cold rolled TPF steel sheet having properties adapted for the production in a conventional industrial annealing line. Accordingly, the steel shall not only possess good formability properties but at the same time be optimized with respect to $A_{c3}$-temperature, $M_s$-temperature, austempering time and temperature and other factors such as sticky scale influencing the surface quality of the hot rolled steel sheet and the processability of the steel sheet in the industrial annealing line.

DETAILED DESCRIPTION

The invention is described in the claims.

In the following specification the following abbreviations are:

PF=polygonal ferrite,
B=bainite,
BF=bainitic ferrite,
TM=tempered martensite.

RA=retained austenite
$R_m$=tensile strength (MPa)
Ag=uniform elongation, UEl (%)
$A_{80}$=total elongation (%)
Rp0.2=yield strength (MPa)
HR=hot rolling reduction (%)
$T_{an}$=annealing temperature (° C.)
$t_{an}$=annealing time (s)
CR1=cooling rate (° C./s)
$T_Q$=quenching temperature (° C.)
CR2=cooling rate (° C./s)
$T_{RJ}$=stop temperature of rapid cooling (° C.)
$T_{OA}$=overageing/austempering temperature (° C.)
$t_{OA}$=overageing/austempering time (s)
CR3=cooling rate (° C./s)

The cold rolled high strength TPF steel sheet has a composition consisting of the following elements (in wt. %):

| | |
|---|---|
| C | 0.1-0.3 |
| Mn | 1.4-2.7 |
| Si | 0.4-1.0 |
| Cr | 0.1-0.9 |
| Si + Cr | ≥0.9 |
| Al | ≤0.8 |
| Nb | <0.1 |
| Mo | <0.3 |
| Ti | <0.2 |
| V | <0.2 |
| Cu | <0.5 |
| Ni | <0.5 |
| B | <0.005 |
| Ca | <0.005 |
| Mg | <0.005 |
| REM | <0.005 |

balance Fe apart from impurities.

The reasons for the limitation of the elements are explained below.

The elements C, Mn, Si and Cr are essential to the invention for the reasons set out below:

C: 0.1-0.3%

C is an element which stabilizes austenite and is important for obtaining sufficient carbon within the retained austenite phase. C is also important for obtaining the desired strength level. Generally, an increase of the tensile strength in the order of 100 MPa per 0.1% C can be expected. When C is lower than 0.1% then it is difficult to attain a tensile strength of 780 MPa. If C exceeds 0.3% then weldability is impaired. For this reasons, preferred ranges are 0.1-0.25%, 0.13-0.17%, 0.15-0.19% or 0.19-0.23% depending on the desired strength level.

Mn: 1.4-2.7%

Manganese is a solid solution strengthening element, which stabilises the austenite by lowering the $M_s$ temperature and prevents pearlite to be formed during cooling. In addition, Mn lower the $A_{c3}$ temperature. At a content of less than 1.4% it might be difficult to obtain a tensile strength of at least 780 MPa. It may be difficult to obtain a tensile strength of at least 780 MPa already at a content of less than 1.7%. However, if the amount of Mn is higher than 2.7% problems with segregation may occur and the workability may be deteriorated. The upper limit is also determined by the influence of Mn on the microstructure during cooling on the run out table and in the coil since a high Mn contents may result in the formation of a martensite fraction which is unfavourable for cold rolling. Preferred ranges are therefore 1.5-2.5, 1.5-1.7%, 1.5-2.3, 1.7-2.3%, 1.8-2.2%, 1.9-2.3% and 2.3-2.5%.

Si: 0.4-1.0%

Si acts as a solid solution strengthening element and is important for securing the strength of the thin steel sheet. Si is insoluble in cementite and will therefore act to greatly delay the formation of carbides during the bainite transformation as time must be given to Si to diffuse from the precipitating cementite. Si improves the mechanical properties of the steel sheet. However, high Si forms Si oxides on the surface which may result in pickles on the rolls resulting in surface defects. Further, galvanizing is very difficult for high Si contents, i.e. the risk for surface defects increases. Therefore, Si is limited to 1.0%. Preferred ranges are therefore 0.4-0.9%, 0.4-0.8%, 0.5-0.9%, 0.5-0.7% and 0.75-0.90%.

Cr: 0.1-0.9%

Cr is effective in increasing the strength of the steel sheet. Cr is an element that forms ferrite and retards the formation of pearlite and bainite. The $A_{c3}$ temperature and the $M_s$ temperature are only slightly lowered with increasing Cr content. In this type of steel the amount of retained austenite increases with the chromium content. However, due to the retardation of the bainite transformation longer holding times are required such that the processing on a conventional industrial annealing line is made difficult or impossible, when using normal line speeds. For this reason the amount of Cr is preferably limited to 0.8%. Preferred ranges are therefore 0.15-0.6%, 0.15-0.35%, 0.3-0.7%, 0.5-0.7%, 0.4-0.8%, and 0.25-0.35%.

Si+Cr: ≥0.9

Si and Cr are also efficient in reducing the risk for martensite banding in that they counteract the effect of the manganese segregation during casting. In addition, and completely unforeseen, the combined provision of Si and Cr has been found to result in an increased amount of residual austenite, which, in turn, results in an improved ductility. For these reasons the amount of Si+Cr must be 0.9. However, too large amounts of Si+Cr could result in a strong delay of the bainite formation and therefore Si+Cr is preferably limited to 1.4%. Preferred ranges are therefore 1.0-1.4%, 1.05-1.30% and 1.1-1.2%.

Si/Cr=1-5

Si shall be present in the steel in at least the same amount as Cr in order to get a balance between a strong retardation of cementite precipitation and a small delay of the bainite formation kinetics as Si and Cr retards cementite formation and Cr has a strong delaying effect on the bainite formation kinetics. Preferably Si is present in a greater amount than Cr. Preferred ranges for Si/Cr are therefore 1-5, 1.5-3, 1.7-3, 1.7-2.8, 2-3 and 2.1-2.8.

In addition to C, Mn, Si and Cr the steel may optionally contain one or more of the following elements in order to adjust the microstructure, influence on transformation kinetics and/or to fine tune one or more of the mechanical properties.

Al: ≤0.8

Al promotes ferrite formation and is also commonly used as a deoxidizer. Al, like Si, is not soluble in the cementite and therefore considerably delays the cementite formation during bainite formation. Additions of Al result in a remarkable increase in the carbon content in the retained austenite. However, the $M_s$ temperature is increased with increasing Al content. A further drawback of Al is that it results in a drastic increase in the $A_{c3}$ temperature. However, since the inventive TPF alloys can be annealed in the two-phase region substantial amounts of Al may be used. Al is used with success for the substitution of Si in TRIP steel grades. However, a main disadvantage of Al is its segregation behavior during casting. During casting Mn is enriched in the middle of the slabs and the Al-content is decreased.

Therefore in the middle a significant austenite stabilized region or band is formed. This results at the end of the processing in martensite banding and at low strain internal cracks are formed in the martensite band. On the other hand, Si and Cr are also enriched during casting. Hence, the propensity for martensite banding may be reduced by alloying with Si and Cr since the austenite stabilization due to the Mn enrichment is counteracted by these elements. For these reasons the Al content is preferably limited to 0.6%, preferably 0.1%, most preferably to less than 0.06%.

Nb: <0.1

Nb is commonly used in low alloyed steels for improving strength and toughness because of its remarkable influence on the grain size development. Nb increases the strength elongation balance by refining the matrix microstructure and the retained austenite phase due to precipitation of NbC. Hence, additions of Nb may be used to obtain a high strength steel sheet having good deep drawability. At contents above 0.1% the effect is saturated.

Preferred ranges are therefore 0.01-0.08%, 0.01-0.04% and 0.01-0.03%. Even more preferred ranges are 0.02-0.08%, 0.02-0.04% and 0.02-0.03%.

Mo: <0.3

Mo can be added in order to improve the strength. Addition of Mo together with Nb results in precipitation of fine NbMoC carbides which results in a further improvement in the combination of strength and ductility.

Ti: <0.2; V: <0.2

These elements are effective for precipitation hardening. Ti may be added in preferred amounts of 0.01-0.1%, 0.02-0.08% or 0.02-0.05%. V may be added in preferred amounts of 0.01-0.1% or 0.02-0.08%.

Cu: <0.5; Ni: <0.5

These elements are solid solution strengthening elements and may have a positive effect on the corrosion resistance. The may be added in amounts of 0.05-0.5% or 0.1-0.3% if needed.

B: <0.005

B suppresses the formation of ferrite and improves the weldability of the steel sheet. For having a noticeable effect at least 0.0002% should be added. However, excessive amounts of deteriorate the workability.

Preferred ranges are <0.004%, 0.0005-0.003% and 0.0008-0.0017%.

Ca: <0.005; Mg: <0.005; REM: <0.005

These elements may be added in order to control the morphology of the inclusions in the steel and thereby improve the hole expandability and the stretch flangability of the steel sheet.

Preferred ranges are 0.0005-0.005% and 0.001-0.003%.

Si>Al

The high strength cold rolled steel sheet according to the invention has a silicon based design, i.e. the amount of Si is larger than the amount of Al, preferably Si>1.3 Al, more preferably Si>2Al, most preferably Si>3Al.

Mn+3Cr

To avoid a too strong retardation of the bainite formation in the steel sheet of the present invention it is preferred to control the ratio of Mn+3Cr≤3.8, preferably ≤3.6 and more preferred ≤3.4.

$(Rp_{0.2})/(R_m)$

In the steel sheet of the present invention it is preferred to control the yield ratio of $(Rp_{0.2})/(R_m) \leq 0.7$, preferably $(Rp_{0.2})/(R_m) \leq 0.75$, in order to get the desired formability.

The high strength cold rolled TPF steel sheet has a multiphase microstructure comprising (in vol. %)

| | |
|---|---|
| retained austenite | 5-22 |
| bainite + bainitic ferrite + tempered martensite | ≤80 |
| polygonal ferrite | ≥10 |

The amount of retained austenite (RA) is 5-22%, preferably 6-22%, and more preferred 6-16%. Because of the TRIP effect retained austenite is a prerequisite when high elongation is necessary. High amount of residual austenite decreases the stretch flangability. In these steel sheets the matrix mainly consists of the soft polygonal ferrite (PF) with an amount generally exceeding 50%. Only a minor amount of bainitic ferrite (BF) is usually present in the final microstructure. As a consequence of insufficient local austenite stability the structure may also contain some minor amounts of fresh martensite forming during cooling to room temperature.

The high strength cold rolled TPF steel sheet has the following mechanical properties

| | | |
|---|---|---|
| tensile strength ($R_m$) | ≥780 | MPa |
| total elongation ($A_{80}$) | ≥12 | %, preferably ≥13%, more preferred ≥14% |

The $R_m$ and $A_{80}$ values were derived according to the European norm EN 10002 Part 1, wherein the samples were taken in the longitudinal direction of the strip.

The formability of the steel sheet was assessed by the strength-elongation balance ($R_m \times A_{80}$).

The steel sheet of the present invention fulfils the following condition:

| | | |
|---|---|---|
| $R_m \times A_{80}$ | ≥13 000 | MPa % |

The mechanical properties of the steel sheet of the present invention can be largely adjusted by the alloying composition and the microstructure.

In one preferred embodiment the high strength cold rolled steel sheet has a tensile strength of at least 780 MPa wherein the steel comprises:

| | |
|---|---|
| C | 0.17-0.23 |
| Mn | 1.5-1.8, preferably 1.5-1.7 |
| Si | 0.4-0.8, preferably 0.4-1.7 |
| Cr | 0.3-0.7, preferably 0.4-0.7 |
| optionally | |
| Nb | 0.01-0.03, preferably 0.02-0.03 |
| or | |
| C | 0.13-0.17 |
| Mn | 1.7-2.3 |
| Si | 0.5-0.9 |
| Cr | 0.3-0.7 |
| optionally | |
| Nb | 0.01-0.03, preferably 0.02-0.03 |

and wherein the steel sheet fulfil at least one of the following requirements:

| | | |
|---|---|---|
| ($R_m$) | 780-1200 | MPa |
| ($A_{80}$) | ≥15 | % |
| and | | |
| $R_m \times A_{80}$ | ≥14 000 | MPa %, preferably ≥16 000 MPa % |

Typical compositions for the high strength cold rolled steel sheet having a tensile strength of at least 780 MPa could be:

C~0.2%, Mn~1.6%, Si~0.6%, Cr~0.6%, Nb~0 or 0.025%, or

C~0.15%, Mn~1.8%, Si~0.7%, Cr~0.4%, Nb~0 or 0.025%, rest iron apart from impurities.

In another preferred embodiment the high strength cold rolled steel sheet has a tensile strength of at least 980 MPa wherein the steel comprises:

| | |
|---|---|
| C | 0.18-0.22 |
| Mn | 1.7-2.3 |
| Si | 0.5-0.9 |
| Cr | 0.3-0.8 |
| optionally | |
| Si + Cr | ≥1.0 |
| Nb | 0.01-0.03 |
| or | |
| C | 0.14-0.20 |
| Mn | 1.9-2.5 |
| Si | 0.5-0.9 |
| Cr | 0.3-0.8 |
| optionally | |
| Si + Cr | ≥1.0 |
| Nb | 0.01-0.03 |

and wherein the steel sheet fulfil at least one of the following requirements

| | | |
|---|---|---|
| ($R_m$) | 980-1200 | MPa |
| ($A_{80}$) | ≥13 | % |
| and | | |
| $R_m \times A_{80}$ | ≥13 000 | MPa % |

Typical compositions for the high strength cold rolled steel sheet having a tensile strength of at least 980 MPa could C~0.18%, Mn~2.2%, Si~0.8%, Cr~0.5%, Nb~0 or 0.025%, rest iron apart from impurities.

In yet another preferred embodiment the high strength cold rolled steel sheet has a tensile strength ($R_m$) of at least 1180 MPa. In this embodiment the steel comprises

| | |
|---|---|
| C | 0.18-0.22 |
| Mn | 1.7-2.5, preferably 1.7-2.3 |
| Si | 0.5-0.9 |
| Cr | 0.4-0.8 |
| optionally | |
| Si + Cr | ≥1.1 |
| Nb | 0.01-0.03, preferably 0.02-0.03 |

and fulfil at least one of the following requirements

| | | |
|---|---|---|
| ($R_m$) | 1000-1400 | MPa, preferably 1180-1400 MPa |
| ($A_{80}$) | ≥10 | %, preferably ≥14% |
| and | | |
| $R_m \times A_{80}$ | ≥12 000 | MPa %, preferably ≥15 000 MPa % |

A typical composition for the high strength cold rolled steel sheet having a tensile strength of at least 1180 MPa could be:

C~0.2%, Mn~2.2%, Si~0.8%, Cr~0.6%, Nb~0 or 0.025%, rest iron apart from impurities, or C~0.2%, Mn~2%, Si~0.6%, Cr~0.6%, Nb~0 or 0.025%, rest iron apart from impurities.

The high strength cold rolled steel sheet of the present invention can be produced using a conventional industrial annealing line. The processing comprises the steps of:

a) providing a cold rolled strip having a composition as set out above, b) annealing the cold rolled strip at an annealing temperature, $T_{an}$, that is between 760° C. and $A_{c3}$+20° C., followed by c) cooling the cold rolled strip from the annealing temperature, $T_{an}$, to a cooling stop temperature, $T_{RJ}$, that is between 300 and 475° C., preferably 350 and 475° C. at a cooling rate that is sufficient to avoid pearlite formation, followed by d) austempering the cold rolled strip at an overageing/austempering temperature, $T_{OA}$, that is between 320 and 480° C., and e) cooling the cold rolled strip to ambient temperature.

The process shall preferably further comprise the steps of:

in step b) the annealing being performed at an annealing temperature, $T_{an}$, that is between 760 and 820° C., during an annealing holding time, $t_{an}$, of up to 100 s, preferably 60 s, in step c) the cooling can be performed according to a cooling pattern having two separate cooling rates; a first cooling rate, CR1, of about 3-20° C./s, from the annealing temperature, $T_{an}$, to a quenching temperature, $T_Q$, that is between 600 and 750° C., and a second cooling rate, CR2, of about 20-100° C./s, from the quenching temperature, $T_Q$, to the stop temperature of rapid cooling, $T_{RJ}$, and in step d) the austempering of the steel sheet being performed at an overageing/austempering temperature, $T_{OA}$, that is between 350 and 475° C. and an overageing/austempering time, $t_{OA}$, that is between 50 and 600 s.

Preferably, no external heating is applied to the steel sheet between step c) and d).

In one conceivable method of producing the high strength cold rolled steel sheet of the invention the austempering in step d) is performed at an overageing/austempering temperature, $T_{OA}$, which is between 375 and 475° C. for an overageing/austempering time, $t_{OA}$, of 200 s.

In another conceivable method of producing the high strength cold rolled steel sheet of the invention the austempering in step d) is performed an overageing/austempering temperature, $T_{OA}$, which is between of 350 and 450° C. for an overageing/austempering time, $t_{OA}$, of 200 s.

The reasons for regulating the heat treatment conditions are set out below:

Annealing temperature, $T_{an}$, =760° C. to $A_{c3}$ temperature+20° C.:

The annealing temperature controls the recrystallization, the dissolution of cementite and the amount of ferrite and austenite during annealing. Low annealing temperature, $T_{an}$, results in an unrecrystallized microstructure and an insufficient dissolution of cementite. High annealing temperatures results in a fully austenitization and grain growth. This may result in an insufficient ferrite formation during cooling.

Austempering temperature, $T_{OA}$, being between 320 and 480° C.:

By controlling the austempering temperature, $T_{OA}$, to the mentioned range, the amount of bainite, the undesirable precipitation of cementite and therefore the amount and stability of retained austenite, RA, can be controlled. Lower austempering temperature, $T_{OA}$, will lower the bainite formation kinetics and a too small amount of bainite can results in an unsatisfying stabilized retained austenite. A higher austempering temperature, $T_{OA}$, increases the bainite formation kinetic but generally the amount of bainite is reduced and this may result in an unsatisfyingly stabilized retained austenite. A further increase of the austempering temperature could result in undesirable precipitation of cementite.

Cooling stop temperature of rapid cooling, $T_{RJ}$, being between 300 and 475° C.

By controlling the cooling stop temperature of rapid cooling, $T_{RJ}$, a further controlling of the transformation prior austempering is possible and this can be applied for a fine tuning of the obtained amounts of different constituents.

First and second cooling rates, CR1, CR2:

A cooling pattern for cooling the annealed strip from the annealing temperature, $T_{an}$, to the stop temperature of rapid cooling, $T_{RJ}$, may have two separate cooling steps. By controlling the first cooling rate, CR1 to about 3-20° C./s from the annealing temperature, $T_{an}$, to a quenching temperature, $T_Q$, that is between 600 and 750° C. and a second cooling rate, CR2, of about 20-100° C./s from the quenching temperature, $T_Q$, to the stop temperature of rapid cooling, $T_{RJ}$, the amount of polygonal ferrite and, by extension, the amount of austenite may be controlled. Furthermore, by this cooling pattern the formation of pearlite is avoided, as pearlite deteriorates formability properties of the steel sheet. However, a small amount of pearlite may be present in the quenched strip. Up to 1% of pearlite may be present although it is preferred that the quenched strip is void of pearlite.

Third cooling rate CR3:

The cooling schedule from the austempering temperature, $T_{OA}$, to room temperature typical applied in annealing lines has a neglectable impact on the microstructure and mechanical properties of the steel sheet.

EXAMPLES

A number of test alloys A-Q were manufactured having chemical compositions according to table I. Steel sheets were manufactured and subjected to heat treatment using a conventional industrial annealing line according to the parameters specified in Table II. The microstructures of the steel sheets were examined along with a number of other mechanical properties and the result is presented in Table III. In Table I and Table III examples according to the invention or outside the invention are marked by Y or N respectively.

TABLE I

| Steel | C | Si | Mn | P | S | Al | Cr | Ni | Mo | Cu | V |
|---|---|---|---|---|---|---|---|---|---|---|---|
| A | 0.200 | 0.65 | 1.55 | 0.0048 | 0.0041 | 0.069 | 0.015 | 0.009 | <0.001 | 0.014 | <0.001 |
| B | 0.198 | 0.64 | 1.56 | 0.0047 | 0.0034 | 0.063 | 0.300 | 0.009 | 0.001 | 0.013 | <0.001 |
| C | 0.197 | 0.65 | 1.51 | 0.0039 | 0.0021 | 0.060 | 0.550 | 0.014 | <0.001 | 0.014 | <0.001 |
| D | 0.197 | 0.62 | 1.98 | 0.0056 | 0.0065 | 0.055 | 0.014 | 0.010 | 0.003 | 0.015 | 0.002 |
| E | 0.199 | 0.85 | 2.25 | 0.0076 | 0.0068 | 0.046 | 0.120 | 0.011 | 0.003 | 0.017 | 0.002 |
| F | 0.220 | 0.87 | 2.30 | 0.0070 | 0.0054 | 0.045 | 0.320 | 0.009 | 0.002 | 0.017 | 0.002 |
| G | 0.200 | 0.84 | 2.26 | 0.0081 | 0.0049 | 0.046 | 0.580 | 0.011 | 0.003 | 0.016 | 0.002 |
| H | 0.210 | 0.84 | 2.00 | 0.0077 | 0.0050 | 0.050 | 0.310 | 0.010 | 0.003 | 0.017 | 0.002 |
| I | 0.210 | 0.84 | 2.24 | 0.0079 | 0.0051 | 0.048 | 0.320 | 0.011 | 0.003 | 0.017 | 0.002 |
| J | 0.220 | 0.84 | 2.23 | 0.0082 | 0.0040 | 0.054 | 0.320 | 0.011 | 0.003 | 0.017 | 0.002 |
| K | 0.198 | 0.55 | 1.51 | 0.0066 | 0.0042 | 0.044 | 0.017 | 0.010 | 0.004 | 0.015 | 0.002 |
| L | 0.196 | 0.72 | 1.49 | 0.0065 | 0.0043 | 0.045 | 0.017 | 0.010 | 0.004 | 0.015 | 0.002 |
| M | 0.200 | 1.09 | 1.52 | 0.0062 | 0.0039 | 0.043 | 0.018 | 0.010 | 0.004 | 0.015 | 0.002 |
| N | 0.200 | 1.52 | 1.50 | 0.0068 | 0.0041 | 0.042 | 0.017 | 0.010 | 0.004 | 0.015 | 0.002 |
| O | 0.131 | 0.84 | 2.31 | 0.0076 | 0.0037 | 0.038 | 0.290 | 0.012 | 0.003 | 0.018 | 0.002 |
| P | 0.250 | 0.82 | 2.34 | 0.0078 | 0.0039 | 0.041 | 0.300 | 0.012 | 0.003 | 0.018 | 0.002 |
| Q | 0.145 | 0.65 | 1.9 | 0.009 | 0.0022 | 0.045 | 0.35 | 0.015 | 0.004 | 0.016 | 0.002 |

| Steel | Nb | Ti | B | N | $A_{C3}$ | Ms | Invention |
|---|---|---|---|---|---|---|---|
| A | <0.001 | <0.001 | 0.0004 | 0.0035 | 802 | 400 | N |
| B | <0.001 | <0.001 | 0.0003 | 0.0038 | 801 | 397 | Y |
| C | <0.001 | 0.001 | 0.0003 | 0.0037 | 803 | 396 | Y |
| D | <0.002 | 0.003 | 0.0003 | 0.0046 | 788 | 388 | N |
| E | 0.027 | 0.003 | 0.0003 | 0.0040 | 790 | 375 | Y |
| F | 0.027 | 0.003 | 0.0004 | 0.0037 | 785 | 362 | Y |
| G | 0.027 | 0.003 | 0.0003 | 0.0047 | 789 | 369 | Y |
| H | 0.026 | 0.003 | 0.0003 | 0.0046 | 794 | 376 | Y |
| I | <0.002 | 0.002 | 0.0004 | 0.0051 | 787 | 369 | Y |
| J | 0.049 | 0.003 | 0.0003 | 0.0051 | 785 | 365 | Y |
| K | <0.002 | 0.003 | 0.0003 | 0.0046 | 799 | 403 | N |
| L | <0.002 | 0.003 | 0.0003 | 0.0047 | 807 | 402 | N |
| M | <0.002 | 0.002 | 0.0003 | 0.0045 | 822 | 396 | N |
| N | <0.002 | 0.003 | 0.0002 | 0.0048 | 842 | 392 | N |
| O | <0.001 | 0.002 | 0.0003 | 0.0038 | 805 | 400 | Y |
| P | <0.001 | 0.002 | 0.0003 | 0.0042 | 775 | 349 | Y |
| Q | 0.025 | 0.003 | 0.0002 | 0.0046 | 808 | 415 | Y |

TABLE II

| Heat cycle No. | HR | $T_{an}$ | $t_{an}$ | CR1 | $T_Q$ | CR2 | $T_{RJ}$ | $T_{OA}$ | $t_{OA}$ | CR3 |
|---|---|---|---|---|---|---|---|---|---|---|
| 1 | 20 | 800 | 60 | 5 | 720 | 50 | 325 | 325 | 600 | 30 |
| 2 | 20 | 800 | 60 | 5 | 720 | 50 | 350 | 350 | 600 | 30 |
| 3 | 20 | 800 | 60 | 5 | 720 | 50 | 375 | 375 | 600 | 30 |
| 4 | 20 | 800 | 60 | 5 | 720 | 50 | 400 | 400 | 600 | 30 |
| 5 | 20 | 800 | 60 | 5 | 720 | 50 | 425 | 425 | 600 | 30 |
| 6 | 20 | 800 | 60 | 5 | 720 | 50 | 450 | 450 | 600 | 30 |
| 7 | 20 | 800 | 60 | 5 | 720 | 50 | 400 | 400 | 120 | 30 |
| 8 | 20 | 800 | 60 | 5 | 720 | 50 | 425 | 425 | 120 | 30 |
| 9 | 20 | 800 | 60 | 5 | 720 | 50 | 450 | 450 | 120 | 30 |
| 10 | 20 | 800 | 60 | 5 | 720 | 50 | 475 | 475 | 120 | 30 |
| 11 | 20 | 800 | 60 | 5 | 720 | 50 | 425 | 425 | 60 | 30 |
| 12 | 20 | 780 | 60 | 5 | 720 | 50 | 400 | 400 | 600 | 30 |
| 13 | 20 | 820 | 60 | 5 | 720 | 50 | 400 | 400 | 600 | 30 |
| 14 | 20 | 880 | 60 | 5 | 720 | 50 | 400 | 400 | 600 | 30 |

TABLE III

| Example | Chemical composition | Heat cycle No. | PF | B + BF + TM | RA | Rp0.2 | Rm | Ag | A80 | Rm × A80 | Invention | Rp0.2/Rm |
|---|---|---|---|---|---|---|---|---|---|---|---|---|
| 1 | A | 4 | 72 | 24.0 | 4.0 | 562 | 713 | 13.5 | 17.5 | 12478 | N | 0.79 |
| 2 | B | 4 | 63 | 29.0 | 8.0 | 598 | 821 | 16.5 | 21.0 | 17241 | Y | 0.73 |
| 3 | C | 4 | 57 | 30.0 | 13.0 | 604 | 825 | 17.5 | 23.5 | 19388 | Y | 0.73 |
| 4 | D | 4 | 38 | 54.5 | 7.5 | 634 | 911 | 9.3 | 13.3 | 12116 | N | 0.70 |
| 5 | E | 4 | 34 | 53 | 13.0 | 613 | 941 | 14.8 | 18.5 | 17409 | Y | 0.65 |
| 6 | F | 4 | 29 | 59.5 | 11.5 | 603 | 1049 | 14.6 | 17.8 | 18672 | Y | 0.57 |
| 7 | G | 4 | 25 | 65.1 | 9.9 | 594 | 1116 | 11.3 | 14.3 | 15959 | Y | 0.53 |
| 8 | H | 4 | 36 | 53.0 | 11.0 | 561 | 919 | 17.3 | 21.1 | 19391 | Y | 0.61 |
| 9 | I | 4 | 27 | 60.9 | 12.1 | 580 | 1021 | 12.9 | 16.4 | 16744 | Y | 0.57 |
| 10 | J | 4 | 30 | 59.1 | 10.9 | 606 | 990 | 13.8 | 17.2 | 17028 | Y | 0.61 |
| 11 | K | 4 | 73 | 20.8 | 6.2 | 523 | 650 | 11.3 | 15.4 | 10010 | N | 0.80 |
| 12 | L | 4 | 67 | 25.2 | 7.8 | 483 | 702 | 14.1 | 17.8 | 12496 | N | 0.69 |
| 13 | M | 4 | 63 | 25.1 | 11.9 | 472 | 735 | 17.4 | 21.5 | 15803 | N | 0.64 |
| 14 | N | 4 | 65 | 20.5 | 14.5 | 504 | 754 | 18.9 | 26.5 | 19981 | N | 0.67 |
| 15 | O | 4 | 43 | 48.1 | 8.9 | 603 | 945 | 10.4 | 14.9 | 14081 | Y | 0.64 |
| 16 | P | 4 | 26 | 59.7 | 14.3 | 667 | 1129 | 10.1 | 12.5 | 14113 | Y | 0.59 |
| 17 | C | 1 | 61 | 31.6 | 7.4 | 663 | 964 | 8.6 | 11.4 | 10990 | N | 0.69 |
| 18 | C | 2 | 59 | 33.0 | 8.0 | 648 | 903 | 11.9 | 16.1 | 14538 | Y | 0.72 |
| 19 | C | 3 | 58 | 32.5 | 9.5 | 624 | 843 | 15.1 | 18.9 | 15933 | Y | 0.74 |
| 20 | C | 4 | 60 | 29.2 | 10.8 | 598 | 829 | 15.9 | 20.5 | 16995 | Y | 0.72 |
| 21 | C | 5 | 62 | 25.5 | 12.5 | 482 | 823 | 17.5 | 21.8 | 17941 | Y | 0.59 |
| 22 | C | 6 | 65 | 28.5 | 6.5 | 513 | 894 | 12.8 | 17.3 | 15466 | Y | 0.57 |
| 23 | C | 7 | 58 | 28.5 | 13.5 | 476 | 877 | 15.9 | 20.2 | 17715 | Y | 0.54 |
| 24 | C | 8 | 62 | 23.4 | 14.6 | 478 | 842 | 18.3 | 24.3 | 20461 | Y | 0.57 |
| 25 | C | 9 | 61 | 23.8 | 15.2 | 422 | 861 | 16.2 | 21.2 | 18253 | Y | 0.49 |
| 26 | C | 10 | 65 | 25.9 | 9.1 | 427 | 891 | 15.2 | 18.8 | 16751 | Y | 0.48 |
| 27 | Q | 8 | 38 | 50.1 | 11.9 | 512 | 821 | 17.8 | 22.6 | 18555 | Y | 0.62 |
| 28 | Q | 11 | 36 | 52.5 | 11.5 | 498 | 835 | 16.4 | 20.6 | 17201 | Y | 0.60 |
| 29 | H | 12 | 39 | 50.6 | 10.4 | 516.6 | 889.2 | 17.1 | 20.7 | 18406 | Y | 0.58 |
| 30 | H | 13 | 31 | 58.8 | 10.2 | 681.2 | 968.1 | 12.5 | 16.8 | 16264 | Y | 0.70 |
| 31 | H | 14 | <5 | >86 | 9.0 | 784.2 | 973.6 | 8.7 | 12 | 11683 | N | 0.81 |

INDUSTRIAL APPLICABILITY

The present invention can be widely applied to high strength steel sheets having excellent formability for vehicles such as automobiles.

The invention claimed is:

1. A high strength cold rolled steel sheet comprising:

a) a composition consisting of the following elements, in wt. %:

| | |
|---|---|
| C | 0.1-0.3 |
| Mn | 1.4-2.7 |
| Si | 0.4-0.9 |
| Cr | 0.1-0.9 |
| Si + Cr | 0.9-1.4 |
| Si/Cr | 1-5 |
| Si | >10 Al |
| Al | ≤0.6 |
| Nb | <0.1 |
| Mo | <0.3 |
| Ti | <0.2 |
| V | <0.2 |
| Cu | <0.5 |
| Ni | <0.5 |
| S | ≤0.01 |
| P | ≤0.02 |
| N | ≤0.02 |
| B | <0.005 |
| Ca | <0.005 |
| Mg | <0.005 |
| REM | <0.005 |

balance Fe apart from impurities, b) a multiphase microstructure consisting of, in vol. %

| | |
|---|---|
| retained austenite | 5-22 |
| bainite + bainite ferritie+ tempered martensite | ≤80 |
| polygonal ferrite | >5 |

wherein a maximum size of the retained austenite (RA) is ≤6 μm, c) the following mechanical properties

| | | |
|---|---|---|
| a tensile strength ($R_m$) | ≥780 | MPa |
| an elongation ($A_{80}$) | ≥12 | % |

and optionally fulfilling the following condition

| | |
|---|---|
| $R_m \times A_{80}$ | ≥13 000 MPa %. |

2. The high strength cold rolled steel sheet according to claim 1, wherein at least one of the following elements is in the composition, in wt. %:

| | |
|---|---|
| C | 0.13-0.25 |
| Mn | 1.5-2.5 |
| Cr | 0.2-0.6. |

3. The high strength cold rolled steel sheet according to claim 1, wherein at least one of the following elements is in the composition, in wt. %:

| | |
|---|---|
| Nb | 0.02-0.08 |
| Mo | 0.05-0.3 |
| Ti | 0.02-0.08 |

-continued

| | |
|---|---|
| V | 0.02-0.1 |
| Cu | 0.05-0.4 |
| Ni | 0.05-0.4 |
| B | 0.0002-0.003 |
| Ca | 0.0005-0.005 |
| Mg | 0.0005-0.005 |
| REM | 0.0005-0.005. |

4. The high strength cold rolled steel sheet according to claim 1, wherein, in wt. %:

| | |
|---|---|
| Ti | >3.4N. |

5. The high strength cold rolled steel sheet according to claim 1, wherein the multiphase microstructure consists of, in vol. %:

| | |
|---|---|
| retained austenite | 6-16 |
| bainite + ferritic bainite + tempered martensite | ≤80. |

6. The high strength cold rolled steel sheet according to claim 1, wherein the composition consists of:

| | |
|---|---|
| C | 0.17-0.23 |
| Mn | 1.5-1.8 |
| Si | 0.4-0.8 |
| Cr | 0.3-0.7 |
| optionally | |
| Nb | 0.01-0.03 |

and wherein the steel sheet fulfils at least one of the following requirements:

| | |
|---|---|
| ($R_m$) | 780-1200 MPa |
| ($A_{80}$) | ≥15% |
| and | |
| $R_m \times A_{80}$ | ≥16 000 MPa %. |

7. The high strength cold rolled steel sheet according to claim 1, wherein the composition consists of:

| | |
|---|---|
| C | 0.13-0.17 |
| Mn | 1.7-2.3 |
| Si | 0.5-0.9 |
| Cr | 0.3-0.7 |
| optionally | |
| Nb | 0.01-0.03 |

and wherein the steel sheet fulfils at least one of the following requirements:

| | |
|---|---|
| ($R_m$) | 780-1200 MPa |
| ($A_{80}$) | ≥15% |
| and | |
| $R_m \times A_{80}$ | ≥14 000 MPa %. |

8. The high strength cold rolled steel sheet according to claim 1 wherein the composition consists of:

| | |
|---|---|
| C | 0.18-0.22 |
| Mn | 1.7-2.3 |
| Si | 0.5-0.9 |
| Cr | 0.3-0.8 |
| optionally | |
| Si + Cr | 1.0-1.4 |
| Nb | 0.01-0.03 |

and wherein the steel sheet fulfils at least one of the following requirements

| | |
|---|---|
| ($R_m$) | 980-1200 MPa |
| ($A_{80}$) | ≥13%. |

9. The high strength cold rolled steel sheet according to claim 1, wherein the composition consists of:

| | |
|---|---|
| C | 0.14-0.20 |
| Mn | 1.9-2.5 |
| Si | 0.5-0.9 |
| Cr | 0.3-0.8 |
| optionally | |
| Si + Cr | 1.0-1.4 |
| Nb | 0.01-0.03 |

and wherein the steel sheet fulfils at least one of the following requirements

| | |
|---|---|
| ($R_m$) | 980-1200 MPa |
| ($A_{80}$) | ≥13%. |

10. The high strength cold rolled steel sheet according to claim 1, wherein the composition consists of:

| | |
|---|---|
| C | 0.18-0.22 |
| Mn | 1.7-2.5 |
| Si | 0.5-0.9 |
| Cr | 0.4-0.8 |
| optionally | |
| Si + Cr | ≥1.1 |
| Nb | 0.01-0.03 |

and wherein the steel sheet fulfils at least one of the following requirements:

| | |
|---|---|
| ($R_m$) | 1000-1400 MPa |
| ($A_{80}$) | ≥10% |
| and | |
| $R_m \times A_{80}$ | ≥15 000 MPa %. |

11. The high strength cold rolled steel sheet according to claim 1, wherein the ratio Mn+3×Cr≤3.8.

12. The high strength cold rolled steel sheet according to claim 1, wherein the ratio of Si/Cr=1.5-3.

13. The high strength cold rolled steel sheet according to claim 1, which is not provided with a hot dip galvanizing layer.

14. The high strength cold rolled steel sheet according to claim 2, wherein Mn is between 1.5-2.5 wt. % in the composition.

15. The high strength cold rolled steel sheet according to claim 14, wherein Mn is between 1.7-2.3 wt. % in the composition.

16. The high strength cold rolled steel sheet according to claim 4, wherein at least one of the following elements is in the composition, in wt. %:

| | |
|---|---|
| S | ≤0.003 |
| P | ≤0.01 |
| N | ≤0.005. |

17. The high strength cold rolled steel sheet according to claim 1, wherein the maximum size of the retained austenite (RA) is ≤3 μm.

18. The high strength cold rolled steel sheet according to claim 6, wherein the composition consists of:

| | |
|---|---|
| Mn | 1.5-1.7 |
| Si | 0.4-0.7 |
| Cr | 0.4-0.7 |
| optionally | |
| Nb | 0.02-0.03. |

19. The high strength cold rolled steel sheet according to claim 11, wherein the ratio Mn+3×Cr≤3.6.

20. The high strength cold rolled steel sheet according to claim 19, wherein the ratio Mn+3×Cr≤3.4.

21. The high strength cold rolled steel sheet according to claim 12, wherein the ratio of Si/Cr=1.7-3.

22. The high strength cold rolled steel sheet according to claim 21, wherein the ratio of Si/Cr=1.7-2.8.

23. The high strength cold rolled steel sheet according to claim 1, wherein the elongation ($A_{80}$)≥13%.

24. The high strength cold rolled steel sheet according to claim 7, wherein the composition consists of:

| | |
|---|---|
| Nb | 0.02-0 0.03. |

25. The high strength cold rolled steel sheet according to claim 7, wherein the steel sheet fulfils the following requirement:

| | |
|---|---|
| $R_m \times A_{80}$ | ≥16 000 MPa %. |

26. The high strength cold rolled steel sheet according to claim 10, wherein the composition consists of:

| | |
|---|---|
| Mn | 1.7-2.3. |

27. The high strength cold rolled steel sheet according to claim 10, wherein the composition consists of:

| | |
|---|---|
| Nb | 0.02-0.03. |

28. The high strength cold rolled steel sheet according to claim 10, wherein the steel sheet fulfils the following requirement:

| | |
|---|---|
| ($R_m$) | 1180-1400 MPa. |

29. The high strength cold rolled steel sheet according to claim 10,

| | |
|---|---|
| ($A_{80}$) | ≥14%. |

* * * * *